US008006682B2

(12) United States Patent
Vanek

(10) Patent No.: US 8,006,682 B2
(45) Date of Patent: Aug. 30, 2011

(54) ADJUSTABLE ARCHERY BOW MONOPOD AND QUIVER APPARATUS AND METHODS

(76) Inventor: Jonathan Vanek, Pleasant Hill, CA (US)

( * ) Notice: Subject to any disclaimer, the term of this patent is extended or adjusted under 35 U.S.C. 154(b) by 491 days.

(21) Appl. No.: 12/231,145

(22) Filed: Aug. 29, 2008

(65) Prior Publication Data

US 2010/0051006 A1 Mar. 4, 2010

(51) Int. Cl.
*F41B 5/00* (2006.01)
*F41B 5/06* (2006.01)

(52) U.S. Cl. ..... 124/86; 124/25.5

(58) Field of Classification Search ..... 124/23.1, 124/25.5, 25.6, 25.7, 86, 88; 224/916
See application file for complete search history.

(56) References Cited

U.S. PATENT DOCUMENTS 5,619,981 A * 4/1997 Breedlove ..... 124/89
6,330,881 B1 * 12/2001 Pippard ..... 124/25.7
7,311,097 B1 * 12/2007 Callis ..... 124/23.1
7,434,773 B1 * 10/2008 Minjares ..... 248/181.1
7,484,699 B1 * 2/2009 Ziegler et al. ..... 248/156

* cited by examiner

*Primary Examiner* — John Ricci
(74) *Attorney, Agent, or Firm* — Matlock Law Group, P.C.

(57) ABSTRACT

A support tube is attachable via a bracket to the riser of an archery bow, the support tube being bored to accept the diameter of a sheath tube of a telescoping leg, and the sheath tube of the telescoping leg having a connection means for a cap to secure it in said support tube. The telescoping leg is optional, having lockable segments and a removable foot to provide secure footing on a variety of surfaces. The quiver portion of the apparatus is also optional and comprises an upper hood portion and a lower notched plate, both attachable to the support tube, together or separately. Methods for assembly and use are provided.

29 Claims, 6 Drawing Sheets

ADJUSTABLE ARCHERY BOW MONOPOD AND QUIVER APPARATUS AND METHODS

CROSS-REFERENCES TO RELATED APPLICATIONS

This application claims no benefit of any prior patent application or issued patent.

BACKGROUND

The present invention relates to an apparatus to support an archery bow in a ready position for a long period of time, and more particularly to an adjustable bow monopod and quiver apparatus of adjustable height.

It is well known in the art that in archery, either during a hunt, in target practice or even in competition, there may be a long period of time waiting until it is time to take a shot. While waiting, the user must hold the bow with one hand at full arm extension while drawing the bowstring with the opposing arm to the full extension of the bowstring; the greater the bow extension, the greater the bow tension and fatigue of the user. Various devices have been developed for the purpose of resting the user's arm during this waiting period and were sometimes adaptable to bows or other similar devices, such as crossbows, guns, etc.

A well-known device stabilizing the bow features a bipod attached to the bow through a footplate. This device permits the transfer of the weight of the bow to the ground, thus stabilizing it.

Another well known device is the Arm Steady Brace, which is attached to the arm and can be anchored to the shooter's body, and also features an adjustable telescoping leg, and may be drawn from the downward or retracted position to the upwardly extended position and locked therein.

Not as popular as the precedent solutions, the Bow Steady Rest and holder uses a swiveling support boom attached to a vertical surface, with vertical support elements attached near the distal end of the boom, and a bow attaching device holding the bow at the riser between the hand grip and upper limb.

Similar to the Arm Steady Brace is a device stabilizing the user's arm, and is a portable accessory to an archer's bow. The stabilizing arm is attached to the bow, has a rotating mechanism, and a shaft which is adjustable to rest on the archer's hip, thigh, leg or foot, or may also be used to stabilize the bow on the ground or from an overhead object.

However, due to the design limitations in the aforementioned products, none provides the advantages of the present invention. Bow hunting sometimes demands from the user the ability to follow a moving target, and this opportunity cannot be offered by the inventions mentioned above, since some require to the user to stay in sitting position in a tree or other perches optimal to a given location, and others challenge the user to assemble them before using them and to dismantle them after they are done. They need to be carried around by the user when he is moving and this can increase fatigue due to weight and increased bulk.

Therefore, there is need for a lightweight, easily attachable, semi-permanent device, which will not need to be dismounted from the bow each time the user needs to move. The present invention addressees those needs created by the shortcomings of the aforementioned products. The apparatus disclosed herein consists of a lightweight, easily attachable monopod and quiver, used in combination or separately which, instead of being dismantled when the user is done, is simply retracted if the telescoping leg is installed. After being installed, the device becomes a part of the bow, thus guaranteeing to the user mobility while hunting; however, the disclosed apparatus requires no permanent modifications to the archery bow. While removal is not necessary, uninstalling the apparatus, either in combination or as separate pieces is simple, and returns the bow to its original state.

BRIEF SUMMARY OF THE INVENTION

An adjustable monopod and quiver apparatus for use with an archery bow, comprising a telescoping leg of said monopod, which serves to adjust in height and rest on a surface so that the weight of the archery bow is transferred from the user's arm to the surface upon which the monopod is placed; a sheath tube, integral to the sheath tube of the telescoping leg, for the purpose of holding the fully retracted leg, with connection means for a cap; a support tube, bored to accommodate the sheath tube of said telescoping leg, and to which quiver components may be attached, and comprises further an archery bow attachment point; a cap, attachable to the telescoping leg sheath tube, removable for disassembly and which, when in place, functions to hold the telescoping leg in place in the support tube; a removable end piece attaching to the bottom end of said telescoping leg for the purpose of providing stability for the monopod on a multiplicity of surfaces; an attachable hood comprising the upper portion of said quiver for the purposes of shielding the user from arrow tips, attachable to said support tube; and a plate with a multiplicity of notches, comprising the lower portion of said quiver connectable to said support tube, for the purpose of holding arrow shafts in place, wherein upon the segments of said telescoping leg are attached to lock and release mechanisms that release to allow the telescoping segments to travel and lock to hold the telescoping segments in place as desired, and further, wherein said support tube securely attaches to the riser of said archery bow, and wherein said apparatus can be used with or without said quiver hood and finally, wherein said apparatus can be used with or without said removable end piece.

In certain aspects, the embodiment can include attachment point that are U-bolts, dovetail braces, 2-piece sliding, mating braces or means that enable the use of ordinary bolts, screws and pins as fastening means.

In certain aspects, the embodiment can include a telescoping leg having at least one telescoping segment or can have a multiplicity of telescoping segments.

In certain aspects, the embodiment can include telescoping leg releasing, locking means which can be levered clamp locks, locking knobs, locking twist-lock collars or pneumatic push button to release each single leg segment to travel and further, which allows the user to lock each single leg segment in place.

In certain aspects, the embodiment can include segments of the telescoping leg constructed from lightweight aluminum material, carbon fiber material, or wood.

In certain aspects, the embodiment can include a removable end piece of said telescoping leg formed from rubber or soft plastic.

In certain aspects, the embodiment can include a quiver hood that is permanently attached or detachable and can optionally be lined with a foam or foam-like material with indents to secure arrows.

A method is disclosed for assembling an adjustable monopod and quiver apparatus for use with an archery bow, comprising the following steps in any order: attaching a bracket to a riser of an archery bow; attaching a support tube, bored to accommodate the sheath tube of a telescoping leg, to the bracket; optionally inserting a sheath tube, integral to a telescoping leg and with connection means for a cap, into the support tube; optionally mechanically coupling the cap connection means to the sheath tube; optionally attaching a removable end piece to the bottom end of the telescoping leg; optionally attaching a hood comprising the upper portion of the quiver; and optionally attaching a plate comprising a multiplicity of notches, the notched plate comprising the lower portion of the quiver.

The support tube, telescoping leg, quiver hood and notched quiver plate can all be attached to the archery bow at once or only the support tube, telescoping leg, and notched quiver plate at once, or further still only the support tube and telescoping are attached to the archery bow at once, without the quiver hood or the notched quiver plate. Alternately, the support tube and the notched quiver plate are attached to the archery bow without the quiver hood or the telescoping leg, or the support tube, quiver hood and the notched quiver plate are attached to the archery bow without the telescoping leg.

The support tube is connected to the archery bow with U-bolt, dovetail brackets, a 2-piece sliding, mating bracket or with ordinary bolts, screws and pins.

Users can rest the telescoping leg of an adjustable quiver and monopod apparatus on a surface by ensuring that an end piece, with a means of attaching and detaching, is attached to the end of a telescoping leg, or they can ensure that a removable end piece is detached and removed from the end of a telescoping leg.

A method for adjusting one or many segments of a telescoping leg assembly of an adjustable monopod and quiver apparatus, comprises the following steps in any order: unlocking a lock and release mechanisms attached to each telescoping leg segment, adjusting the length of the segment from a current position, and locking said lock and release mechanism attached to each telescoping leg segment.

Any step can be accomplished using locking, releasing mechanisms such as levered clamp locks, locking knobs, locking twist-lock collars, spring-loaded locks or locking pneumatic push buttons.

The disclosed apparatus is mountable to a left- or right-handed archery bow.

DETAILED DESCRIPTION OF THE DRAWINGS

Figure 1:
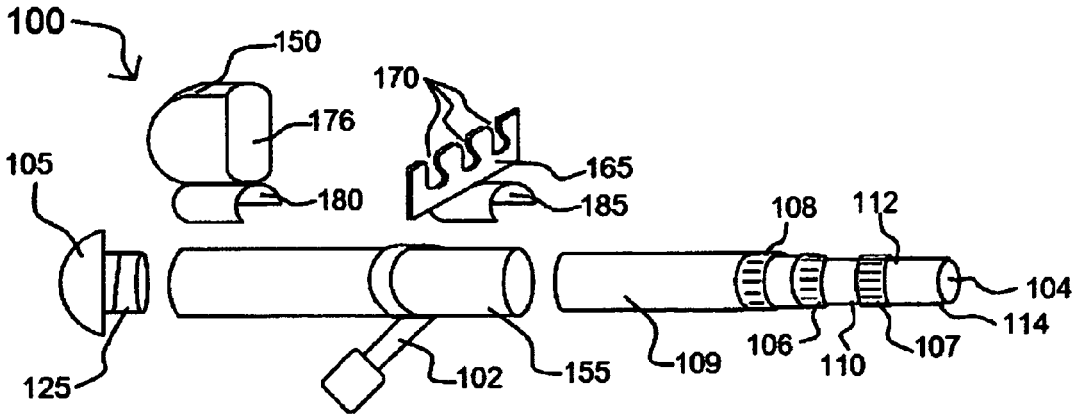
FIG. 1 shows an Adjustable Bow Monopod Apparatus Assembly fully retracted

Specific examples of components and arrangements are described below to simplify the present disclosure. Most notably, Applicant uses a compound bow as a means of illustration in all exemplary embodiments in this paper. However, the utility of the instant invention applies equally to all archery bow types, including but not limited to recurve bows, reflex bows, self or stick bows, straight bows, long bows and short bows. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts the quiver and monopod apparatus 100 with the telescoping leg in the fully retracted position 100. The device as shown consists in its upper portion of a sheath tube 109 and an end cap 105 at its top. In some embodiments, the end cap 105 is threaded to mate with interior threading integral to the interior circumference of the sheath tube. This threading 125 provides a means for installing the telescoping leg assembly 104, 105, 106, 107, 108, 109, 110 into a support tube 155.

The support tube of the apparatus 155 is equipped with an attachment point 102 is designed to be affixed to the bow. In some embodiments, this is a sliding mating bracket, but is reducible to practice as many types of attachment means, such as U-Bolts, dovetail brackets and ordinary screws and bolts. The sheath tube 109 fits inside the support tube 155.

The lower portion of the device consists of a telescoping leg 110 with three segments 110, 112, 114 and three releasing, locking mechanisms 106, 107, 108. The releasing, locking mechanisms 106, 107, 108 can be levered clamp locks, locking knobs, locking twist-lock collars or pneumatic push buttons, which can be unlocked to permit the extension of the telescoping leg, and further, which allows the user to lock each single leg segment in place. The bottom of the apparatus 104 is rounded for the purpose of stabilizing the device when it is deployed to the ground and is removable.

The quiver of the apparatus comprises a hood 150 attachable to a support tube 155 by a semi-circular molded grip 180, which fits snugly on the sheath tube. Also attachable to the support tube 155 is a notched quiver component for holding arrow shafts. The notched quiver component consists of a brace 165 with a multiplicity of notches 170 and a semi-circular molded grip 185, which fits snugly on the support tube 155. It is worth noting that the quiver hood may be permanently attached to the support tube during manufacture in some embodiments, or may be optional and removable in others. In configurations where it is optional, removal of the optional hood shall not interfere with the quiver's ability to hold arrows in a stable manner. Likewise, the notched quiver plate may be permanently affixed to the support tube in some embodiments. The semi-circular molded grips of the exemplary removable notched plate and hood are not meant to limit the present invention.

In some methods for the installation of the apparatus of the present invention, the quiver, with a hood, and the telescoping leg may both be attached to the support tube and may in turn be installed onto an archery bow. Another method for the installation of the apparatus of the present invention, the quiver, without a hood, and the telescoping leg may be attached, and together may be installed onto an archery bow. Still another method to install the apparatus is to attach the telescoping leg to the archery bow alone by inserting the sheath tube into the support tube and attaching the end cap to the top. In yet another method of installation of the apparatus, the telescoping leg is detached from the support tube, and the quiver is attached to the archery bow alone by snapping the semi-circular grips onto the sheath tube.

In some embodiments, the telescoping leg, the quiver and the combined unit may be universally mountable to any archery bow. In other embodiments, mounting brackets, separately or in conjunction with the mount means of the support tube may be particular to the configuration and construction of a particular archery bow or a range of archery bows.

For purposes of discussion, clamp lock levers depicted in a position parallel to the axis of the telescoping leg are considered to be closed or locked. Clamp locks pictured perpendicular to the axis of the telescoping leg are considered open or unlocked. The use of this particular type of latch and lock, as well as this particular lock and unlock latch configuration as a fastener to hold the telescoping leg in place is not meant to limit the invention. Rather, any number of latching and locking means can be employed for this purpose, including locking knobs, twist-lock collar fasteners found on many telescoping tripods, and pneumatic push button-operated mechanisms such as are found in floor jacks, are equally suited for the purpose.

Figure 2:
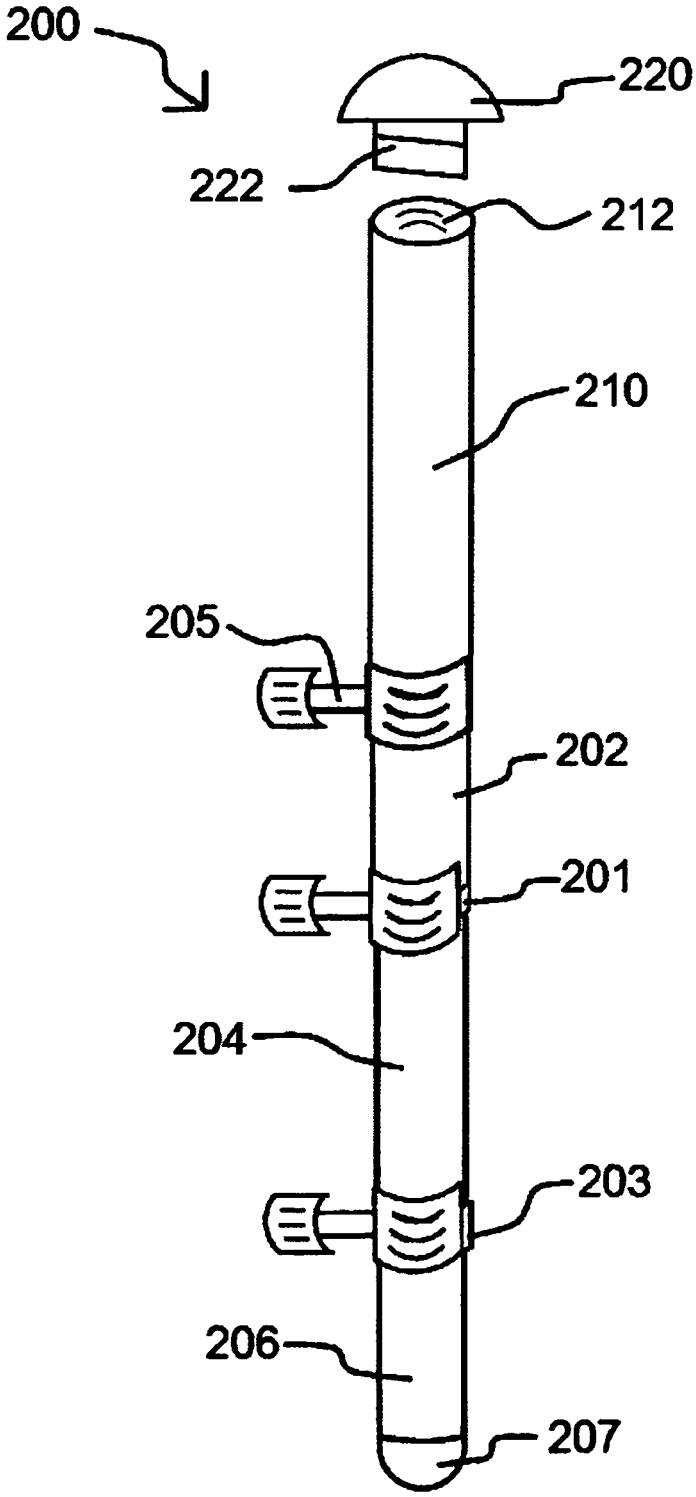
FIG. 2 illustrates an Adjustable Bow Monopod Apparatus Assembly at full extension

FIG. 2 illustrates the telescoping leg of the apparatus as shown in its fully extended position. As shown, the telescoping leg in the figure is equipped with three separate clamp locks. The top most clamp lock 205 locks and unlocks the top segment of the retractable part of the leg 202, the middle clamp lock 201 locks and unlocks the middle segment of the leg 204, and the bottom most clamp lock 203 locks and unlocks the bottom segment 206 of the retractable leg. It is worth noting that while the illustrations depict a telescoping leg with three segments, there could be as few as one segment or as many as is desirable to maintain a lightweight and easy-to-use device. The sheath tube 210 is bored to hold the fully retracted leg segments 202, 204 and 206 and is threaded 212 at the top to accept the end cap 220 threads 222. The outside diameter of the sheath tube is sized to be inserted into the support tube 155 of FIG. 1.

The three clamp locks as shown are in an unlocked position, allowing the leg to extend or retract, as to be locked in the desired position. The three separate clamp locks operate independently, allowing the telescoping leg to be adjusted to any incremental height between the fully retracted length and the fully extended length of the apparatus of the present invention, permitting the adjustment of the device commensurate with the height of the person using it. Thus, the telescoping leg does not have to be fully extended. Further, it is at the user's the discretion to consider if one or all segments of the telescoping leg should be extended to a suitable height to allow said user to rest his arm while waiting to shoot at the intended target.

The bottom of the telescoping leg of the apparatus is equipped in this figure with a removable end piece 207. This rubber bottom boot (also shown in FIG. 1, 104), helps to stabilize the device when placed on rough ground. The removable end piece can be removed by the user as needed and replaced with multiple options to for better stabilization for the shooter in any environment, such as a spike, pronged foot or rubber boot.

Figure 3:
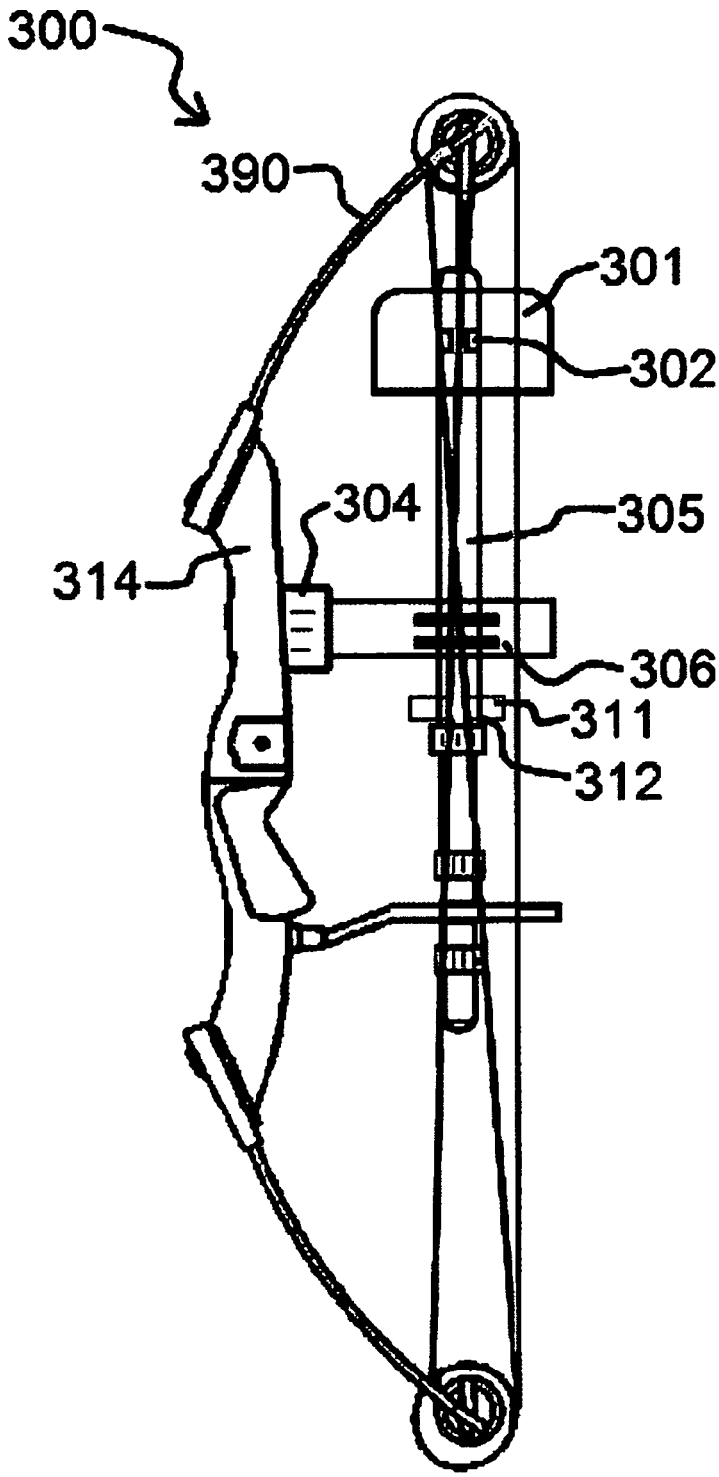
FIG. 3 is a side view showing first preferred embodiment of the Adjustable Bow Monopod Apparatus fully retracted of the invention attached to a bow and a quiver.

FIG. 3 discloses a side view showing the fully retracted telescoping leg of the present invention attached to the quiver of the present invention and an archery bow 300. The apparatus as shown consists of an archery bow attached to the fully retracted apparatus. One having skill in the art will recognize that the apparatus can be mounted quickly and easily without having specialized knowledge.

The support tube of the apparatus 305 can easily be mounted to the archery bow and comprises an attachment point 306 that will be installed to specific parts of the bow. In the embodiments illustrated in this Application, a dovetail bracket is used to connect the apparatus to the archery bow. One end of the dovetail bracket 304 is connected to the riser 314 of the archery bow, while mating end of the bracket 306 is attached to the support tube 305. The use and details of attaching a dovetail bracket to the riser of an archery bow is well known in the art and will not be discussed here. The quiver hood 301 is attached by the semi-circular grip 302 to the outer circumference of the support tube 305, and the notched plate 311 is attached to the outer circumference of the support tube 305 also by a semi-circular grip 312. The apparatus is shown from the rear to illustrate attachment means.

As shown in FIG. 3, the fully retracted telescoping leg of the apparatus becomes a part of the archery bow, like the quiver. Due to the light weight of the telescoping leg, the weight of the bow is not significantly increased, and therefore can still be moved and carried easily.

Figure 4:
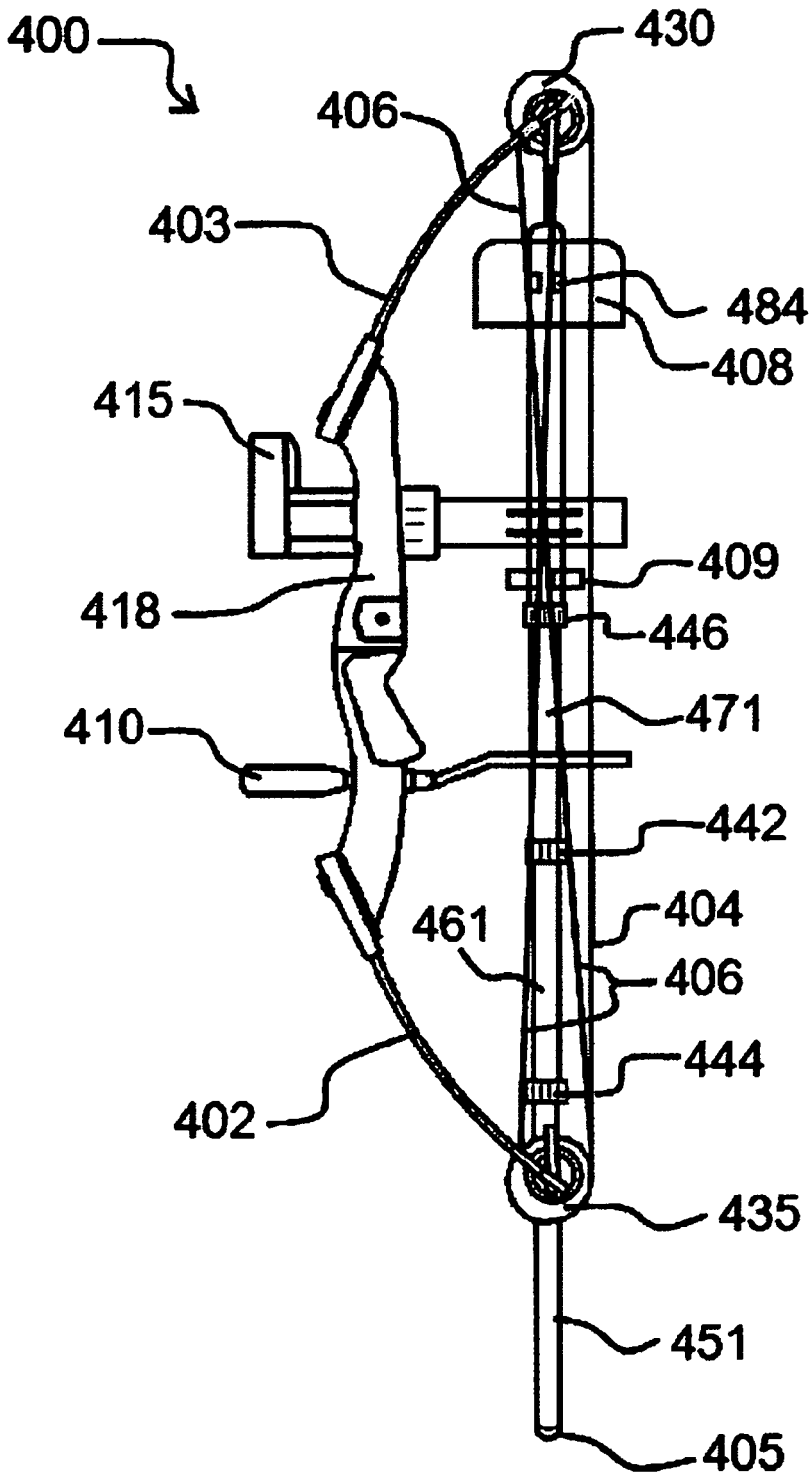
FIG. 4 is a side view showing first preferred embodiment of the Adjustable Bow Monopod Apparatus of the invention at full extension attached to a bow and a quiver.

FIG. 4 is a side view showing the telescoping leg of the present invention at its full extension while attached to a bow and a quiver 400. Specifically, it shows an archery bow equipped with a quiver 408, 409 and the fully extended telescoping leg 471, 442, 461, 444, 451, 446 of the currently disclosed invention, attached by the method explained in FIG. 3, with the clamp locks in the closed and locked position. The removable rubber boot 405 rests on the ground. FIG. 4 clearly demonstrates the utility of the Applicant's claimed invention.

A standard archery bow, as shown, consists of two limbs (upper 403 and lower limb 402), connected by a handle or a riser 418. At the extremities of those limbs are two cams or wheels, 430 and 435 holding a string 404 and cable 406. The user keeps the control of the cables through the device known as a cable guard. Increased accuracy in shooting is achieved through the use of a hunting stabilizer 410, which reduces the movement of the bow when the string is released. Finally, the bowsight 415 increases shot accuracy.

While waiting to shoot the intended target, the user must hold the bow with one hand at full arm extension while maintaining tension on the bowstring 404 with the opposing arm to the full extension of the bowstring. The greater the bow extension, the greater will be the bow tension and the fatigue of the user. One having skill in the art will confirm that holding the bowstring is at full extension, combined with holding the full weight of the bow, often causes some hand shaking, sacrificing shot accuracy.

To use the disclosed invention in one embodiment, after the apparatus has been attached to the bow as shown in FIG. 4, the user unlocks any or all of the clamp locks 442, 444 and 446 to deploy the desired segments 451, 461, 471 of the retractable leg. The user then allows the leg segments to telescope until the desired total extension is reached, just like a tripod leg, and then closes the lock or locks 442, 444, and 446 to hold the retractable segments of the leg in position. The telescoping leg stays parallel to the unpulled string 404. The maximum height of the apparatus is designed to hold the bow off of the ground at a comfortable height for most adult users; the maximum height is approximately 3 feet, but can be manufactured to be longer to accommodate very tall users, or shorter to accommodate different height ranges in women and youths to further reduce weight.

The apparatus of the currently disclosed invention, when deployed to the ground, holds the weight of the bow by transferring the bow's weight from the hand of the user to the ground through the connection of the apparatus to the bow and its contact with the ground. In doing so, use of the telescoping leg apparatus reduces hand tremble and stabilizes the archery bow. As a result, the user's shot accuracy will improve.

The telescoping leg is retracted, if desired, when the user is no longer targeting, when the user is able to track a target without employing its use, or when the user is moving the archery bow to a different location. To retract the telescoping leg, the clamp lock or clamp locks must be unlocked for each part that was extended, the extended segments collapsed, and the clamp locks closed once again to lock the legs in place.

In another aspect of the present invention, the adjustable leg permits the user to use the device from a kneeling position by telescoping the retractable leg or parts of it only minimally, as desired, to achieve a deployed height less than the maximum available height.

A further aspect of the present invention is related to the location where the invention is used. Not all the hunters hunt by tracking on foot. Some prefer to wait for game in a specific place, where they can have the best view and rest at the same time. Some hunters perch in trees, others have tree stands or ground blinds. The rubber boot of the present invention is particularly suited to rough, uneven surfaces. On smoother surfaces like tree branches, the user can remove the rubber bottom boot for better stability. The rubber boot bottom covers the bottom segment of the telescoping leg and, in the presently discussed embodiment, is removed to reveal the metal end of said bottom segment, with edges suitable for gripping smoother surfaces such as tree bark.

The quiver component of the presently discussed apparatus is now discussed separately and in greater detail. Referring back to FIG. 1, in one embodiment, the quiver has an optional hood 150 which, when used, protects the user from sharp arrow tips and hunting tip accessories such as razor blades. In further embodiments, the hood may be optionally lined in its interior cavity 176 with foam (not shown) or a foam-like material (not shown) with indentations. In still other embodiments, providing the functionality just described, the hood may be permanently affixed to the quiver. With respect to the notched portion of the quiver, comprising the plate 165 connected to the support tube permanently or by a means that allows it to be removed, and a multiplicity of notches 170, the notches function for the purpose of holding arrow shafts in place. It should be noted that in both embodiments with permanently attached hoods and notched plates and will optionally attaching hoods and notched plates, the number of notches are the same and are in the same configuration as the indentations in any optional material lining the hood. Further, it should be noted that the quiver component of the apparatus is constructed from materials similar to those used in common standalone quivers, or of the same material as the telescoping leg component of the apparatus. Common materials used in the art of quiver construction are aluminum, carbon fiber and ABS plastic.

It is worth noting that a wide range of materials can be used to construct the apparatus of the presently disclosed invention, but only a few exemplary materials are explicitly discussed. Applicant's limitation of the discussion to exemplary materials is not in any way meant to limit the materials used in the invention as practiced, and to demonstrate that a range of variations of the product can be produced to satisfy both entry-level and high-end markets. Lightweight aluminum is employed commonly as a material for telescoping legs in tripods. It is cheap, durable and readily available, and can be cast into a number of leg designs, from round to elliptical and squared. Carbon fiber is extremely lightweight and durable, and has also been employed in tripod manufacturing. Wood, while not lightweight, is well known for its excellent ability to dampen vibrations and may be suitable in applications where weight and an absolute minimum total retracted length are less important than stability.

It is important to note that the apparatus of the present invention is adaptable to both right- and left-handed archery bows.

Figure 5:
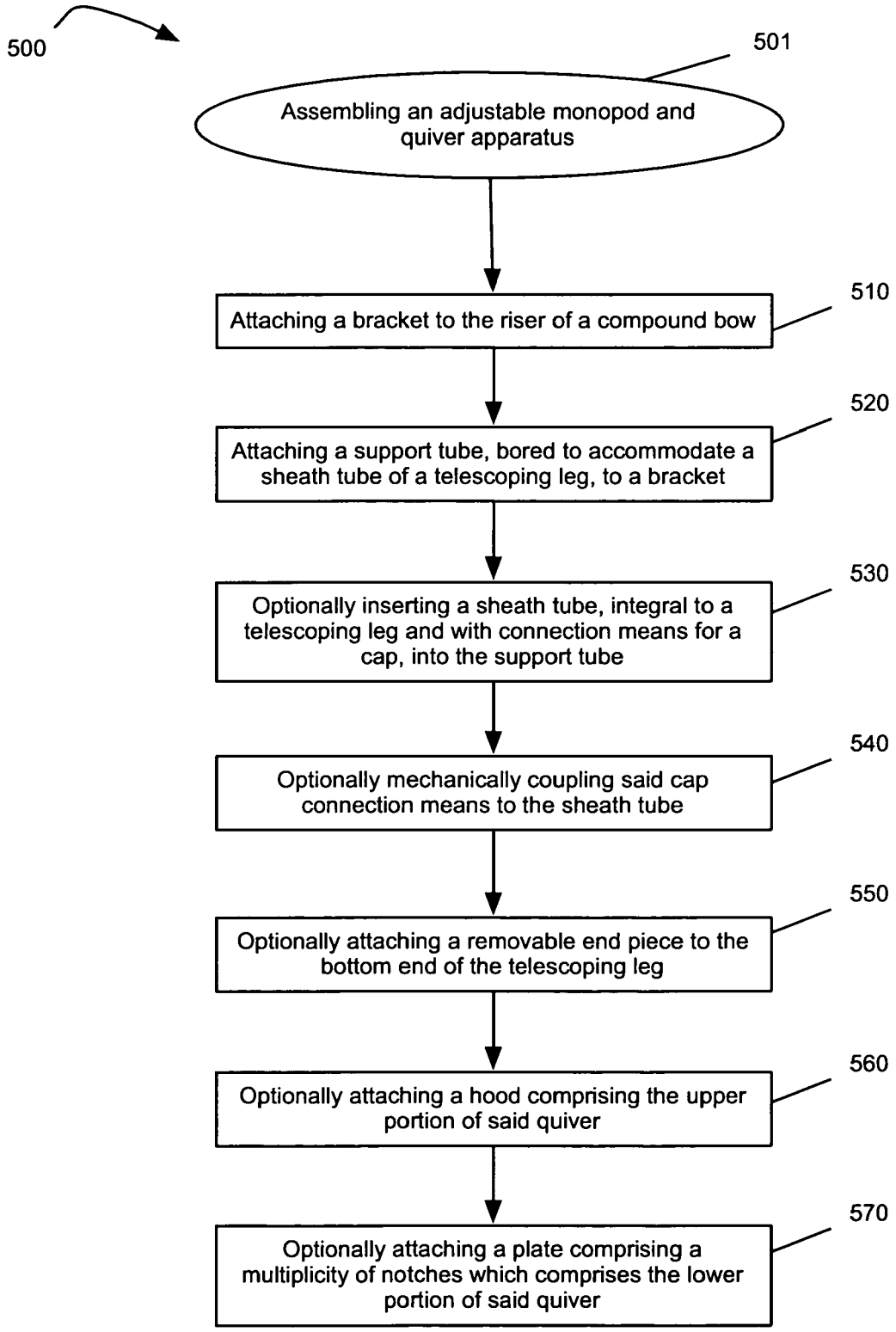
FIG. 5 is a diagram describing the method for assembling the archery bow monopod and quiver apparatus.

Next, FIG. 5 describes a method 500 for assembling an adjustable monopod and quiver apparatus for use with an archery bow 501. In this method, the user attaches 510 a bracket to the riser of an archery bow, and then attaches 520 a support tube, bored to accommodate a sheath tube of a telescoping leg, to the bracket. Optionally, if the user wishes to have a telescoping leg to stabilize the archery bow, the user then inserts 530 a sheath tube, integral to a telescoping leg and with connection means for a cap, into said support tube, and then mechanically couples 540 the cap connection means to the sheath tube, locking the telescoping leg in place in the support tube. The user may also optionally attach 550 a removable end piece to the bottom end of the telescoping leg for added stability on a variety of surfaces. Another step in the method for assembling the apparatus is to optionally attach 560 a hood, which comprises the upper portion of the quiver, and optionally attach 570 a plate comprising a multiplicity of notches, which comprising the lower portion of the quiver that holds the arrow shafts.

Figure 6:
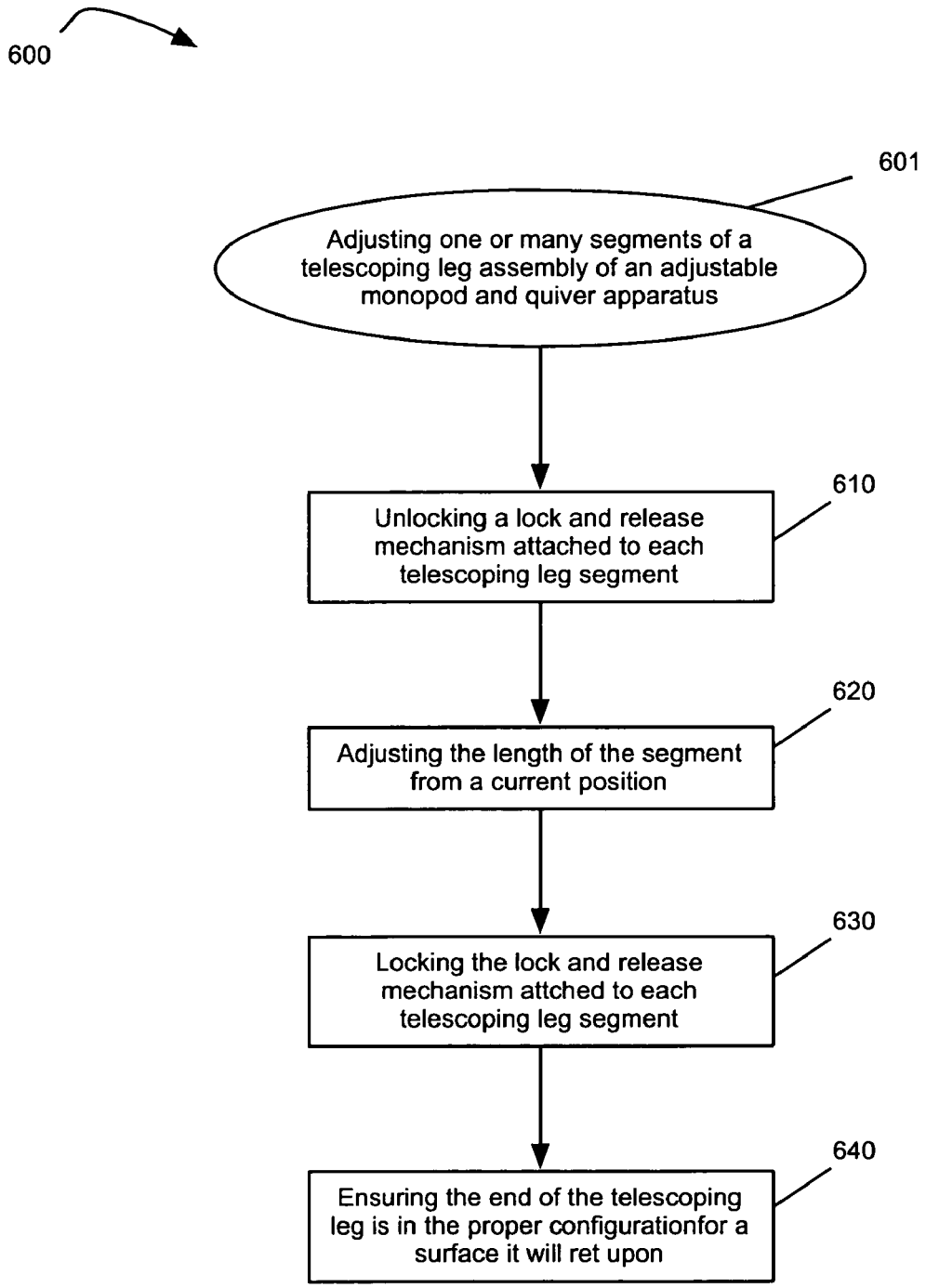
FIG. 6 is a diagram describing the method for adjusting one or many segments of the telescoping leg.

FIG. 6 shows a method 600 for adjusting one or many segments of a telescoping leg assembly of an adjustable monopod and quiver apparatus 601. To perform this operation, the user unlocks 610 a lock and release mechanism attached to each telescoping leg segment, then adjusts 620 the length of the segment from a current position. Next, the user locks 630 the lock and release mechanism attached to each telescoping leg segment and ensures 640 that the end of the telescoping leg is in the proper configuration for the surface it will rest on.

While the invention has been described by way of example and in terms of the specific embodiments, it is to be understood that the invention is not limited to the disclosed embodiments or the details shown, since various modifications and structural changes may be made therein without departing from the spirit of the invention and within the scope and range of equivalents of the claims. Hence, it is intended to cover various modifications and similar arrangements as would be apparent to those skilled in the art. Therefore, the scope of the appended claims should be accorded the broadest interpretation so as to encompass all such modifications and similar arrangements, as set forth in the following claims.

What is claimed is:

1. An adjustable monopod and quiver apparatus for use with an archery bow, comprising:

a. a telescoping leg of said monopod, comprising one or more telescoping leg segments, each with a lock and release mechanism, b. a sheath tube, integral to the telescoping leg, bored to hold fully retracted telescoping leg segments, and with connection means for a cap, c. a support tube, bored to accommodate the sheath tube of said telescoping leg, said support tube attachable to a set of quiver components and to the archery bow by an attachment point, d. a cap, attachable to said telescoping leg sheath tube, removable for disassembly, e. a removable end piece attaching to the bottom end of said telescoping leg, f. an attachable hood comprising the upper portion of said quiver components, attachable to said support tube, and g. a lower portion of said quiver components comprising a plate with multiplicity of notches, connectable to said support tube wherein said support tube securely attaches to the riser of said archery bow.

2. The apparatus of claim 1 wherein said attachment point comprises U-bolts.

3. The apparatus of claim 1 wherein said attachment point comprises dovetail brackets.

4. The apparatus of claim 1 wherein said attachment point comprises sliding mating bracket.

5. The apparatus of claim 1 wherein the attachment point enables the use of ordinary bolts, screws and pins as fastening means.

6. The apparatus of claim 1 wherein the telescoping leg has at least one telescoping segments.

7. The apparatus of claim 1 wherein the telescoping leg has a multiplicity of telescoping segments.

8. The apparatus of claim 1 wherein the telescoping leg uses a clamp lock to release each single leg segment to travel and further, allows the user to lock each single leg segment in place.

9. The apparatus of claim 1 wherein the telescoping leg uses a releasing, locking knob to release each single leg segment to travel and further, allows the user to lock each single leg segment in place.

10. The apparatus of claim 1 wherein the telescoping leg uses a releasing, locking twist-lock collar to release each single leg segment to travel and further, allows the user to lock each single leg segment in place.

11. The apparatus of claim 1 wherein the telescoping leg uses a releasing, locking pneumatic push button to release each single leg segment to travel and further, allows the user to lock each single leg segment in place.

12. The apparatus of claim 1 wherein said quiver hood is permanently attached.

13. The apparatus of claim 1 wherein said quiver hood is detachable.

14. The apparatus of claim 1 wherein said quiver hood is lined with a foam material with indents.

15. The apparatus of claim 1 wherein said quiver hood is lined with a foam-like material with indents.

16. The apparatus of claim 1 wherein said quiver hood is unlined.

17. A method for assembling an adjustable monopod and quiver apparatus for use with an archery bow, comprising the following steps in any order:

attaching a bracket to a riser of said archery bow;

attaching a support tube, bored to accommodate a sheath tube of a telescoping leg, to said bracket;

inserting a sheath tube, integral to a telescoping leg and with connection means for a cap, into said support tube;

mechanically coupling said cap connection means to said sheath tube;

attaching a removable end piece to the bottom end of said telescoping leg;

optionally attaching a hood comprising an upper portion of said quiver; and optionally attaching a plate comprising a multiplicity of notches, said plate with said notches comprising a lower portion of said quiver.

18. The method of claim 17 wherein the support tube, telescoping leg, quiver hood and notched quiver plate are all attached to the archery bow.

19. The method of claim 17 wherein the support tube, telescoping leg, and notched quiver plate are all attached to the archery bow.

20. The method of claim 17 wherein the support tube and telescoping are attached to the archery bow without the quiver hood or the notched quiver plate.

21. The method of claim 17 wherein the support tube and the notched quiver plate are attached to the archery bow without the quiver hood or the telescoping leg.

22. The method of claim 17 wherein the support tube, quiver hood and the notched quiver plate are attached to the archery bow without the telescoping leg.

23. The method of claim 17 wherein the support tube is connected to the archery bow with U-bolts.

24. The method of claim 17 wherein the support tube is connected to the archery bow with dovetail brackets.

25. The method of claim 17 wherein the support tube is connected to the archery bow with a sliding mating bracket.

26. The method of claim 17 wherein the support tube is connected to the archery bow with ordinary bolts, screws and pins.

27. The method of claim 17 wherein the apparatus is mountable to a left-handed archery bow.

28. The method of claim 17 wherein the apparatus is mountable to a left-handed archery bow.

29. The apparatus of claim 1 wherein the telescoping leg uses a spring-loaded lock to release each single leg segment to travel and further, allows the user to lock each single leg segment in place.

* * * * *